US007896348B1

(12) United States Patent
Echecopar

(10) Patent No.: US 7,896,348 B1
(45) Date of Patent: Mar. 1, 2011

(54) SURFING BOARD GAME

(76) Inventor: Carlos Echecopar, Lima (PE)

( * ) Notice: Subject to any disclaimer, the term of this patent is extended or adjusted under 35 U.S.C. 154(b) by 0 days.

(21) Appl. No.: 12/488,912

(22) Filed: Jun. 22, 2009

(51) Int. Cl.
*A63F 3/00* (2006.01)

(52) U.S. Cl. ..... 273/239; 273/443

(58) Field of Classification Search ..... 273/239, 273/241, 242, 243, 256, 285, 287
See application file for complete search history.

(56) References Cited

U.S. PATENT DOCUMENTS

| | | | | |
|---|---|---|---|---|
| 1,888,940 | A | 12/1932 | Dingledine | |
| 2,158,368 | A * | 5/1939 | Hurt | 434/251 |
| 2,492,423 | A | 12/1949 | Gray | |
| 2,590,002 | A * | 3/1952 | Frazier | 273/108 |
| 2,643,466 | A * | 6/1953 | Bucher | 434/248 |
| 2,940,216 | A | 6/1960 | Koch | |
| 2,975,551 | A * | 3/1961 | Oberinger | 446/135 |
| 3,045,393 | A | 7/1962 | Knott | |
| 3,195,894 | A | 7/1965 | Alsaker | |
| 3,425,694 | A * | 2/1969 | Norris | 273/399 |
| 3,429,067 | A | 2/1969 | Yancey | |
| 3,471,151 | A * | 10/1969 | Pfenninger | 463/61 |
| 3,653,662 | A * | 4/1972 | Welbourn | 273/400 |
| 3,658,336 | A | 4/1972 | Knapp | |
| 3,946,520 | A | 3/1976 | Goldfarb | |
| 4,192,508 | A * | 3/1980 | Livick | 273/118 A |
| 7,325,803 | B1 * | 2/2008 | Miranda | 273/108.5 |
| 7,401,786 | B2 | 7/2008 | Lochfield | |
| 2002/0180155 | A1 | 12/2002 | Lochfield | |
| 2007/0090602 | A1 | 4/2007 | Lochfield | |

* cited by examiner

*Primary Examiner*—Vishu K. Mendiratta
(74) *Attorney, Agent, or Firm*—Sanchelima & Associates, P.A.

(57) ABSTRACT

A method to play wave surfing comprising sliding one magnetic figure holder over a coated wave wall by magnetically engaging the figure holder to one magnetic handle and by manipulating the magnetic figure holder with the magnetic handle to avoid the detachment of the magnetic figure holder while at the same time avoiding obstacles placed on said coated wave wall. A surfing board game comprising, at least one wave wall, at least one magnetic handle, the handle further comprising at least one magnet within the handle and at least one magnetic figure holder, the holder further comprising at least one magnet that is placed within the figure holder, further comprising at least action figure that is placed on the magnetic figure holder. Where the magnetic figure holder is slidably placed onto said wave wall and is magnetically coupled to the magnetic handle to create at least one game level of difficulty.

9 Claims, 5 Drawing Sheets

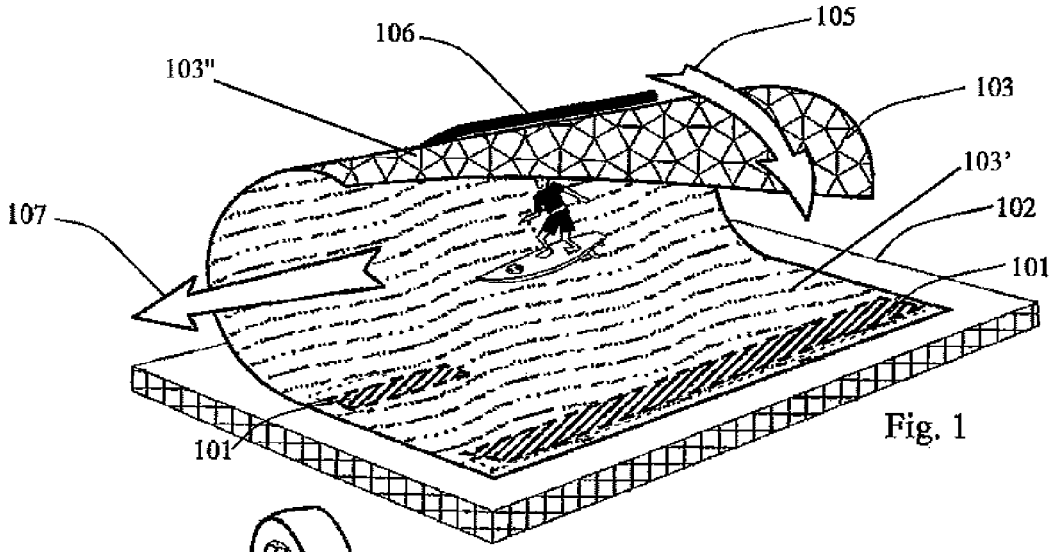
Fig. 1
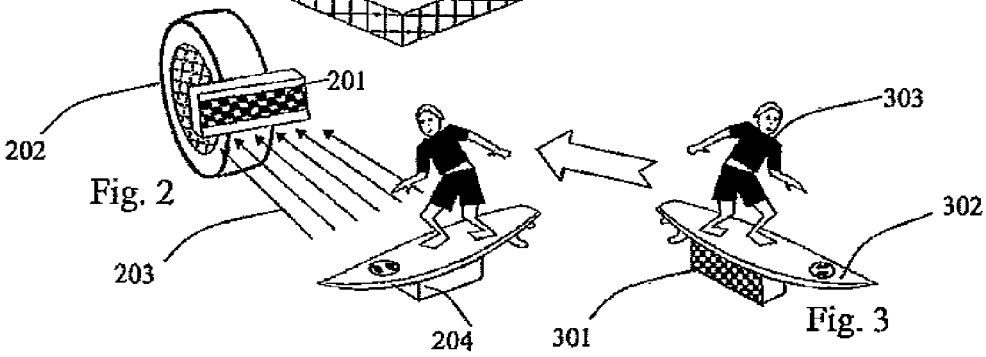
Fig. 2
Fig. 3
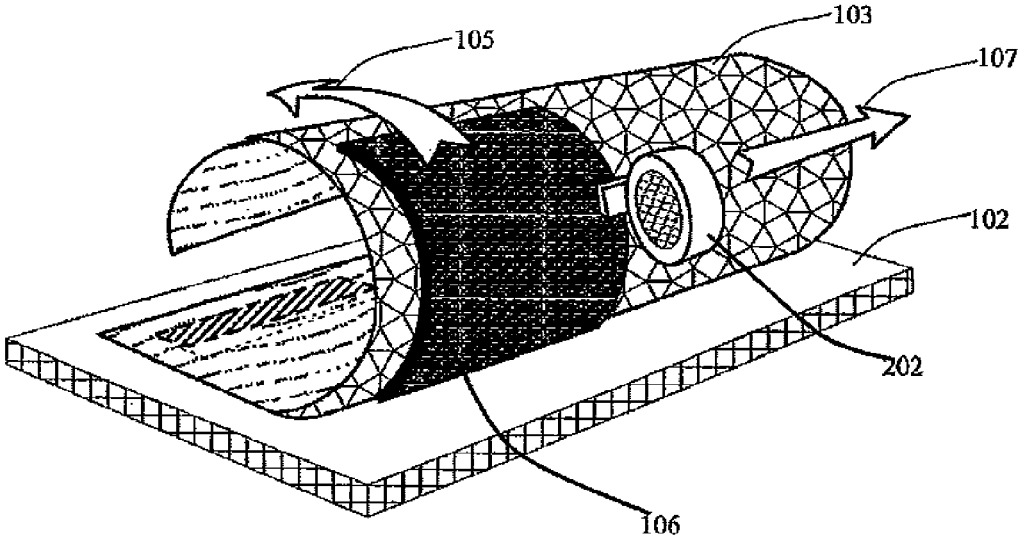
Fig. 4

SURFING BOARD GAME

FIELD OF THE INVENTION

The present invention relates to board games.

BACKGROUND OF THE INVENTION

Many studies have compiled data that more and more children are becoming addicted to videogames. More than 2 hour per day use "screen time" is "gaming overuse," according to the American Academy of Pediatrics. Children as well as adults are becoming sedentary and only using their thumbs to move players on the screen. The classic games that use dice, boards with squares, and cards are slowly moving away and being replaced with high tech 3D graphic computer generated games. The issue with video (computer) games is that it makes the players "space out" or generate automatic responses to signals. Thus, they make the players react but not think to different situations. Also, video games simply visual, hence no motor skills are developed in the player. At the same time thinking board games are also becoming a thing of the past. One of the reasons they are disappearing is that they are not engaging the player in ways that mimic real outdoor sports. Furthermore, since these games are purely mental, they exercise thinking skills, for example chess, checkers or strategy games, but few motion skills are developed.

There is a need in the board gaming community to create an engaging game that mimics sports. Furthermore, the gaming community has in the past relied on games that are static where the player's motor skills are not used and not measured. Without measuring the motor skills of the player, a player does not know if their motor skill and abilities are improving. There is a further need to create a game that engages the player in a motor skill competition such as surfing world cup. There is also need in the industry, to manufacture a game that develops both a player's fine and gross motor skills and at the same time promote imagination. Moreover, in the board gaming arts, it would be desirable to progress from the classic static board games, to games that are both mentally engaging and at the same time physical motor skills are developed.

BRIEF SUMMARY OF THE INVENTION

The present invention provides a board game that simulates the sport of wave surfing.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the embodiments which are presently preferred. It should be understood, however, that the invention is not limited to the precise arrangements and instrumentalities shown. In the drawings:

FIG. 1 depicts the assembled surf game and the wave sheet caving into an action figure surfer.

FIG. 2 depicts how the magnets attract the action figure holder to the magnetic handle.

FIG. 3 depicts figure holder with and action figure surfer.

FIG. 4 depicts the back side of the wave sheet and the movements of the caving wave and the magnetic handle.

DESCRIPTION OF THE INVENTION

Figure 5:
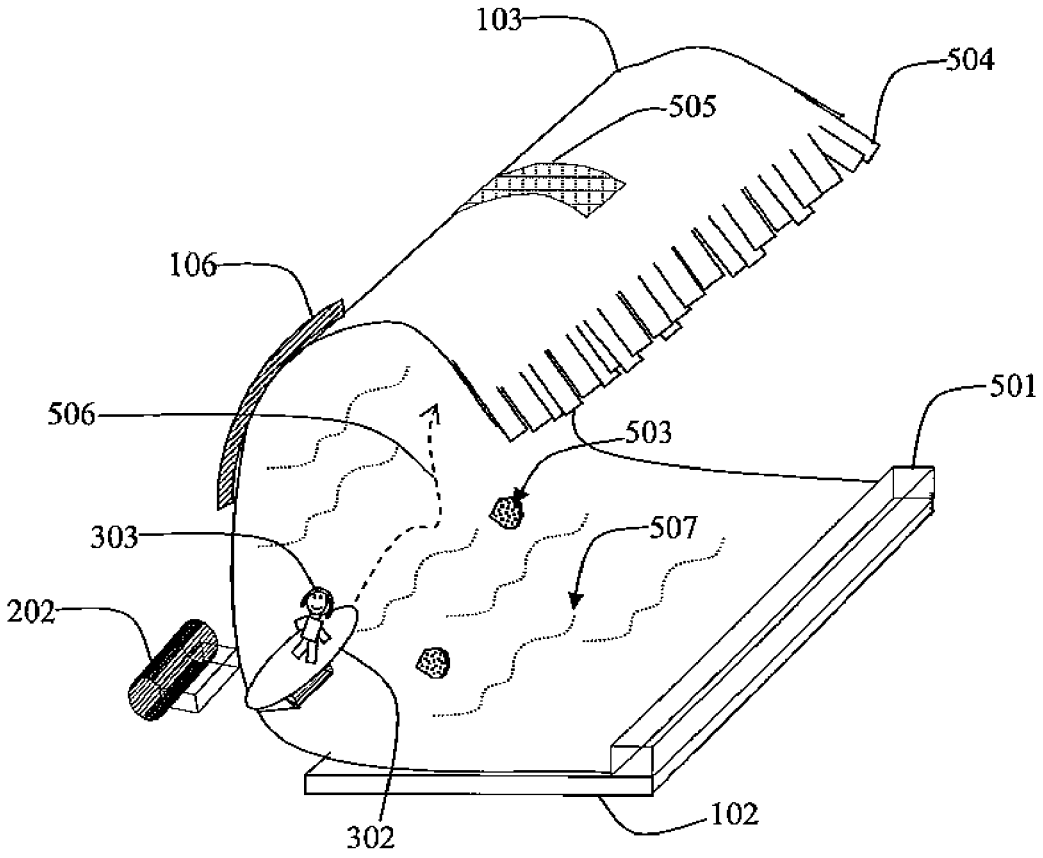
FIG. 5 the assembled game and how the player would maneuver on the wave sheet and though the obstacles, a wave former is also depicted here.

The invention is a board game. The concept of the game is to mimic the sport of wave surfing. The game can be played by at least one person but is preferred to be played in a group so that the game becomes more competitive. As seen in FIG. 1, the board game comprises at least one wave sheet 103 that is attached to at least one base 102 by at least one attachment means 101, the wave sheet 103. The users or players, maneuver the game by holding a magnet handle 202 that in turn attracts at least a magnetic figure holder 204. Said magnetic figure holder 204 further comprises a surf board 302, a magnet or a ferrous material 301 and action figure 303. By using different wave sheets 103, the player's imagination can take off on different waves and surf way around the world. Furthermore, during the player's ride, they will experience the thrills and obstacles every surfer encounters. The user has the option to play the game as "free style surfing" if you want to be entertained, or if prefer you can surf skills with scores of exercises, using scoring sheets and special operations such as criteria used in the Surf World Cup.

The surf game comprises a game for toy surfing through a sheet 103 of thick cardboard paper or paper with the silky texture surface 103' of a sea wave. The sea-wall sheet will be rolling it-self 105 and therefore simulating the gradual formation of a wave as the surfer figure 303 attached to a magnetic figure holder 204, moves perpendicular 107 to the sheet 103 and guided by a handle with a magnet 201 and magnetic handle 202 brought against the opposite surface 103" of sheet 103 opposite to the silky texture surface. The wave sheets 103 are already pre-coiled or pre-rolled to facilitate a gradual rolling of the wave while the surfer advances 107 on the wall of the wave or wave sheet 103. The game is to maneuver on the wave wall as it rolls, and this could last several seconds. The user will be able to do real surfing maneuvers such as: bottom turn, rollers, cutbacks, 360, tube ride, among others. The game comes with several pieces of surfer-figures 303 and colored plastic molded represented various styles of surfers such as a "free styler", and a "surf competitor", a "longboard surfer", a "female surfer" and a "sport." As depicted in FIG. 5, the wave sheets 103 may have obstacles 503 such as rocks and surfers in the water.

Figure 6:
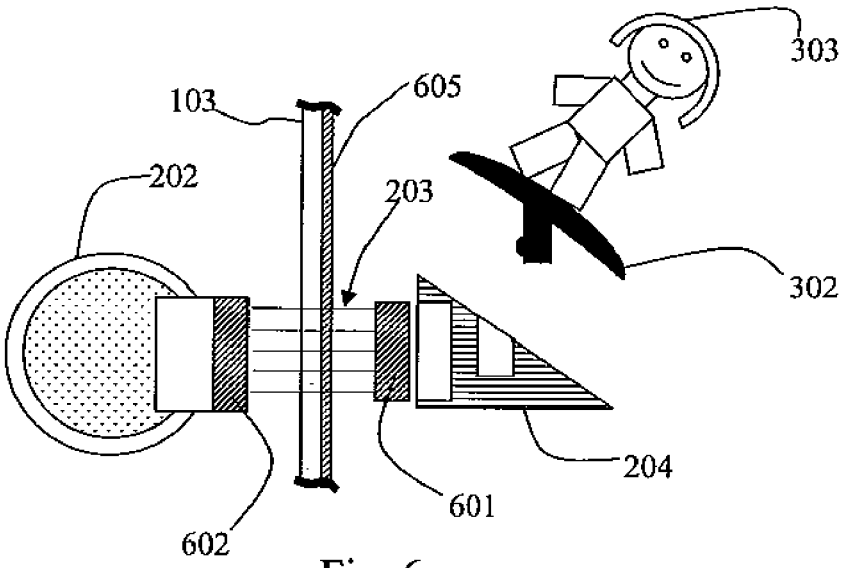
FIG. 6 depicts a crossection of an embodiment of the invention, the magnetic handle, the wave sheet, the wave sheet coating, the magnets, the magnetic flux between the magnets, the action figure, the board and the magnetic figure holder.

The wave sheets or wave sheets 103 come pre-rolled and ready to be glued or be attached on the table by means of clamps 501. The wave sheet 103 is further comprised of a series of wave ends 504 for esthetics and stability to the wall. The strength of the magnet and friction between the surfaces will then unwind the wave wall, while gliding the surfer figure 303 on the wave sheet 103. Inevitably, after some time will be necessary "to force wind" again wave in order to maintain to the angular roll-spring force. This is ingeniously accomplished by the use of a wave former 106 in by applying force in the direction 105. The containment of the angular roll-force of the wave wall was ingeniously solved by attaching a wear-strip 505 of pre-rolled fiber tape behind the wave wall as seen in FIG. 5. wear-strip 505 maintains the original coiled shape longer in use. The wear-strip 505 is made be made from the materials selected from the group consisting of fibers made of organic polymer fiber tape in a polymer binder, and non organic materials such thin as metal wires or coils in a polymer binder. The wear-strip or ware tape 505, and wave wall is formed or molded by a wave-former 106. The wave former has the original shape of the wave and gives the wave wall and the wear-strips 505 the original spring force and shape. Since the wave-strip 505 comprises fibers that are made out of more resilient materials, then the forces are retained more than if it was just the bare wave sheet. For larger waves, a wave former 106 helps the cardboard wave sheet 103 roll on a continuing basis The surf game described herein is a game for manually surfing through a wave sheet 103. The game is to maneuver on a game path 506 on that wave sheet 103 and that lasts several seconds, just like a real wave. The player/user holds the magnetic handle 202 and mimics real surfing maneuvers such as, bottom turn, rollers, cutbacks, tube-ride, 360's, among others or by following a specified or non-specified path 506. The player (like in real surfing) will improve the maneuverability with more practice using the magnetic handle 202. By using his hands and by standing up, motors skills in the body are developed, something that is not found in traditional board games. As depicted in FIG. 6, the magnetic handle 202 attracts the magnetic figure holder 204, using a magnetic field 203 though wave sheet 103 and wave wall coating 605. The magnetic field 203 is created by at least two magnets 601 and 602, where magnet 602 is disposed within the magnet handle 202 and magnet 601 is disposed within the magnetic figure holder 204 respectively. The magnetic figure holder 204 is further comprised of at least one action figure 303 and at least one surf board 302, the surfboard is there mainly for esthetics reasons.

In one embodiment of the invention, the wave sheet 103, was made of at least one sheet of heavy paper or card board stock. However, the wave sheet 103 can be made of materials selected from the group consisting of polymers or plastics, flexible plexi-glass, cellulose materials, thin flexible metals, flexible gypsum cloth and heavy cloth for substantially the same purpose to obtain substantially the same result. The wave sheet 103 was imprinted 507 with the texture to simulate a sea wave that is gradually winding. At least one side of the wave sheet 103 was coated with an epoxy coating 605, which was later cured with UV light. The printed features 507 were covered with the said coating 605. The purpose of the coating 605 is to prevent scratching of the print 507 and to regulate the friction against the wave sheet 103. The coatings 605, could also be made from the materials selected from the group consisting of organic and non organic waxes, acrylic monomers, fluoropolymer composites TEFLON® (PTFE), prepolymers, halogenated compounds, polymer resins, petroleum polymers, and styrene polymers. The coatings 605 are usually applied by using hydrocarbon co-solvents when coating and drying onto the paper or board substrates, to form an inert transparent film. Yet another method that may be used for the substantially the same purpose to obtain substantially the same result is, coating the wave sheet 103 by using of at least a solvent by dispersing a catalyst or quenching agent to a graft initiating or regenerating system by allowing graft polymerization to occur on the cellulose material thus forming the cardboard wave sheet 103.

The game kit also offers several sheets as wave sheets 103 to simulate different beaches. Additional elements are sand, rocks, reefs, palm trees etc, for a better setting of the beach. For the larger waves, larger wave sheets 103 needs assistance of a wave-former 106 this wave maker helps to roll of cardboard continuously. The game kit is presented in a cardboard tube and a means to attach the wave wall sheets to the table. The wave sheet 103 is attached to the board at specific points specified in the instruction sheet. One embodiment of the invention makes the user to use (double sided tape) or sticky tape 101 to attach it to the table. The magnetic figure holder 204 and plastic surfer figure joins the active face of wave through a metal plate located below the magnetic figure holder 204. The user will hold the magnetic handle 202 and guide the surfer from the rear of the wave sheet 103. When the magnetic the magnetic figure holder 204 falls, the surfer "lost balance" and falls off the wave.

Figure 9:
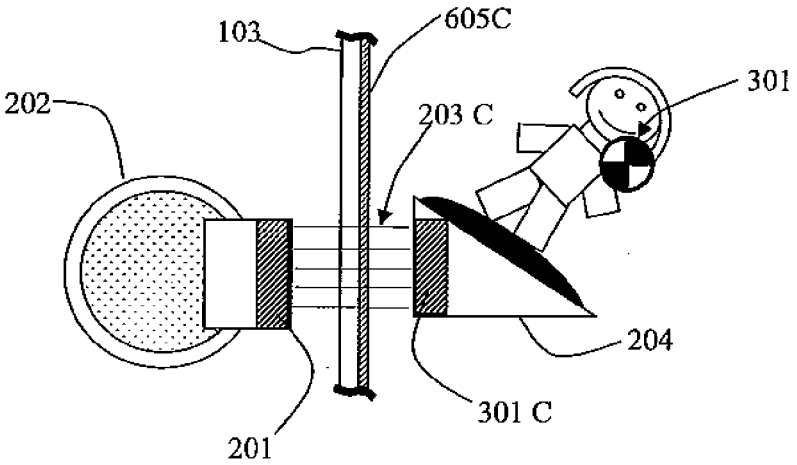
FIG. 9 depicts a crossection of an embodiment of the invention, a magnetic figure holder with yet a different location to the center of gravity and magnetic strength.
Figure 10:
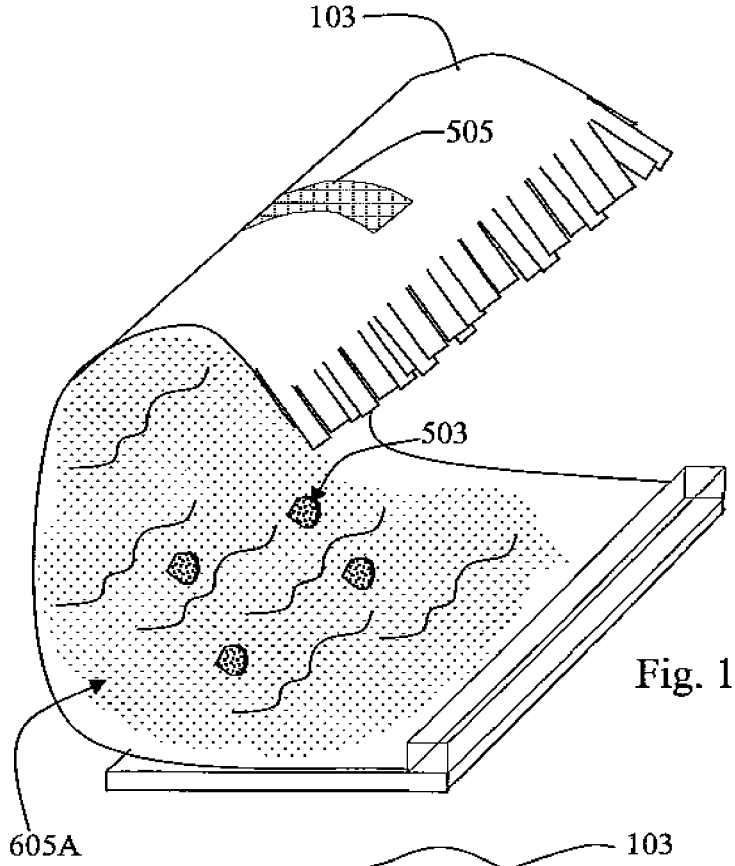
FIG. 10 depicts an embodiment of the invention, a wave sheet with different coating and friction coefficient and obstacles.
Figure 11:
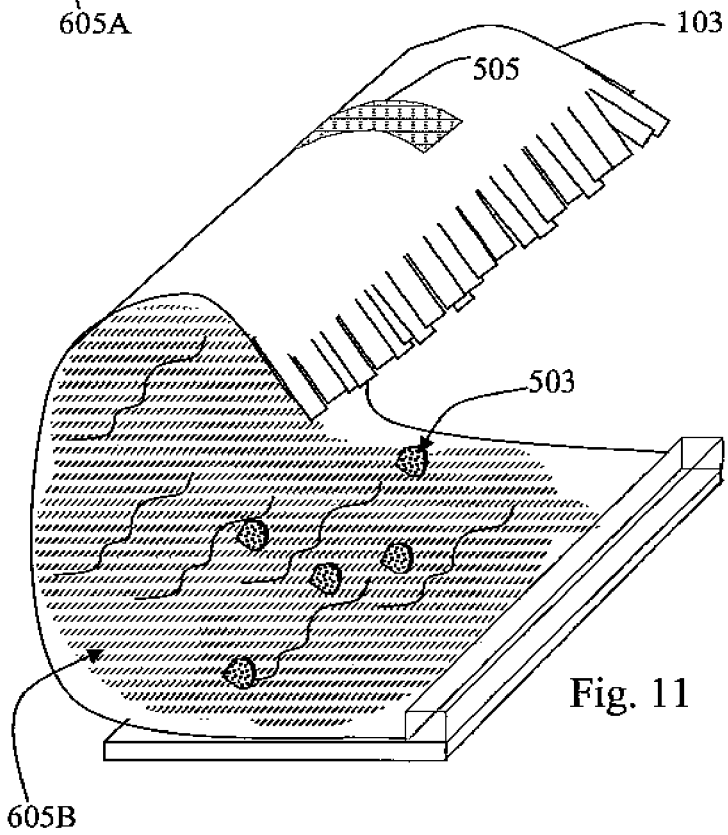
FIG. 11 depicts an embodiment of the invention, a wave sheet with different coating and friction coefficient and obstacles.
Figure 12:
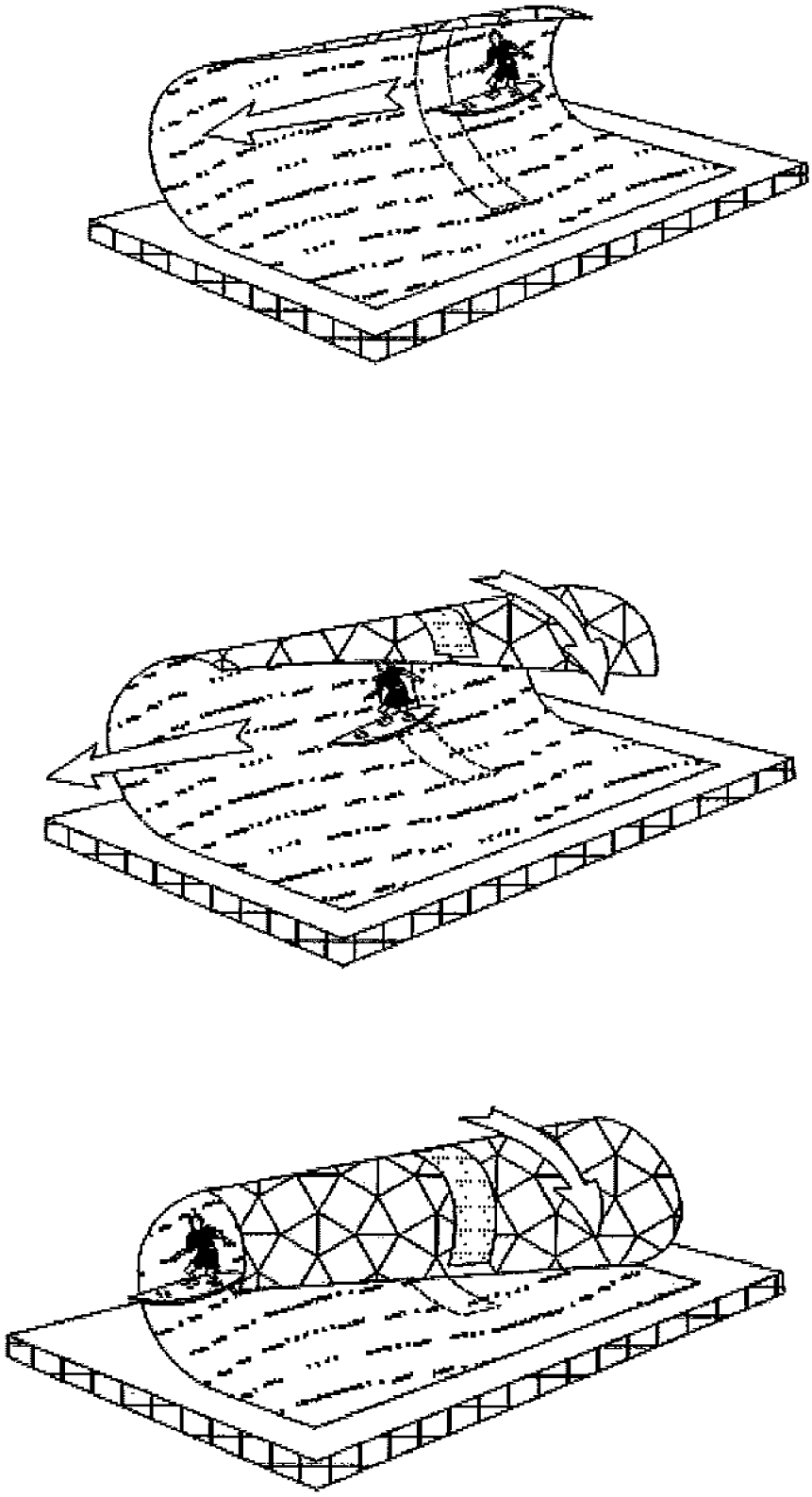
FIG. 12 depicts how the wave sheet collapses and how the action figure surfer would clear a tube.

The level of difficulty is created by using different variable factors depicted in FIG. 9. They are the friction coefficient between the coating material 605 A-C and the magnet 301 A-C, the strength of the magnetic field 203 A-C the position of the center of gravity 301 of the action figure 303 relative to the wave wall 103 and the number of obstacles 503 on the wave sheet 103. As depicted in FIG. 10 and FIG. 11 the different wave walls simulate different beaches, with different obstacles 503. The obstacles 503 can be comprised of sharks, dolphins, rocks and reefs. Palm trees and sand would also enhance the esthetics of the beach. FIG. 12 depicts the continuous motion of the action figure on the surfboard. The difficulty levels are given as the player performs surfing maneuvers while the waves are rolling-in (cascading) while keeping surfaces flat at the point of contact between the magnets, while clearing the obstacles thus mimicking what is surfing is in reality.

Figure 7:
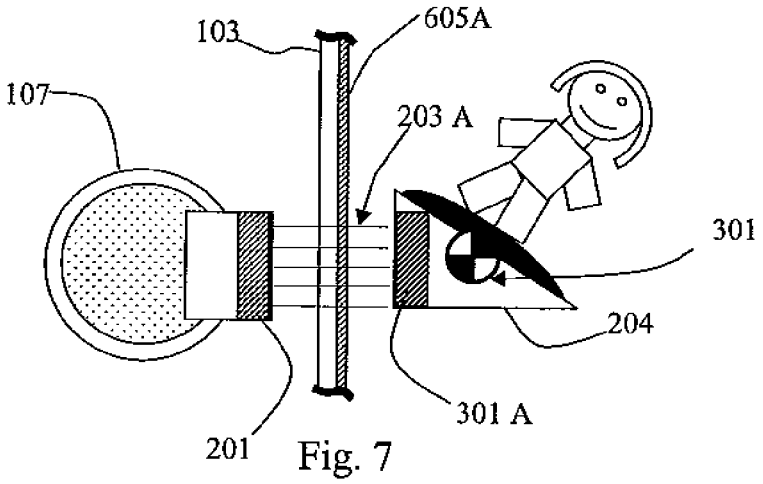
FIG. 7 depicts a crossection of an embodiment of the invention, a magnetic figure holder with different location to the center of gravity and magnetic strength.
Figure 8:
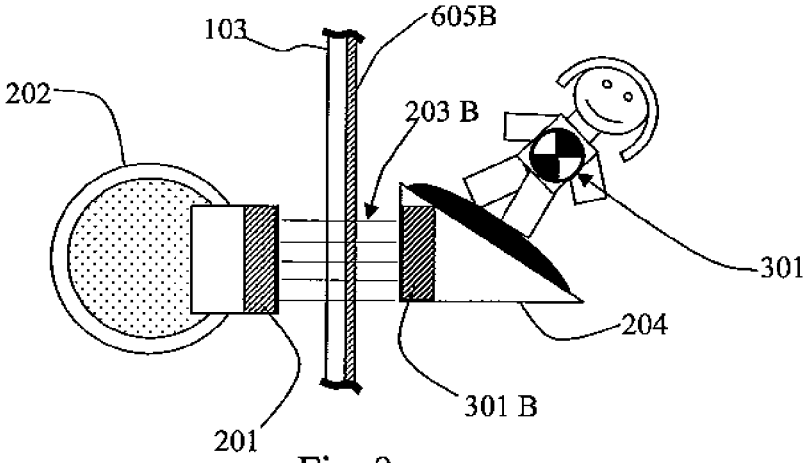
FIG. 8 depicts a crossection of an embodiment of the invention, a magnetic figure holder with different location to the center of gravity and magnetic strength.

The users/players will use the handle bar 202 to make the maneuvers, hand coordination skill will play an important part to clear the obstacles and surf the tube. Depending on the level of skill, and as an option, the player will assemble a magnetic figure holder 204 that the center of gravity 301 is close to the wall such as in FIG. 7, a magnet 301 A with greater magnetic strength 203 A, a wave sheet 103 with larger friction coefficient on the coating 605A, and less obstacles 503. As the player becomes more advanced and skilled, the player will assemble a magnetic figure holder 204 with the center of gravity 301 further away from the wall such as in FIG. 9, a magnet with less magnetic strength 301 C, a wave sheet 103 with lower friction coefficient on the coating 203 C, and more obstacles 503.

The components of the game kit comprise, several wave sheets 103 coated with different coatings 605A-C to create a range of fiction coefficients, at least one attachment means or board holder 501, a base made out of heavy carton 102, several action figures 303 with different center of gravity 301, several magnets 601A-C of different magnetic strength, at least one magnetic figure holder 204, one handle bar 202 further comprising at least a magnet 602, instructions for use with a description of scores and schedules for maneuvering skills, a wave former/shape maker 106 simulating the formation of a true "wave" as a the action figure moves. The game is be presented in a cardboard box and assembled on a table. The player can use the wave sheet 103 to play just too see how long the action figure remains on the board, just as free surf, or the player may play with others to show surf skills a maneuvers with using scores for different maneuvers, by means of a spreadsheet and ad hoc scoring criteria. The game also offers Surf World Cup. The scores will be used to visualize the progress of the motor skills as well as the maneuvering skills of the players.

In an embodiment of the invention, the several pieces of surfer action figures 112 are made of colored plastic and metal. The metal is placed at different locations in the action figure body 112 in order to dictate the location of the center of gravity 301. The metal is later covered with molded plastic. The obstacles 503 are made of plastic covered metal pieces and some are also made out of wood. Also the obstacles can be made of injected molded plastic but can also be made out of wood or cork with rubber lining for the substantially the same purpose to obtain substantially the same result. The base holder 501 is made of two clamp springs that clamp the wave sheet 103 in order to switch to more difficult wave walls. The handle 107 was made out of injected molded plastic but can also be made out of wood or cork with rubber lining for substantially the same purpose to obtain substantially the same result.

It will be appreciated by those skilled in the art that changes could be made to the embodiments described above without departing from the broad inventive concept thereof. It is understood, therefore, that this technology is not limited to the particular embodiments disclosed, but it is intended to cover modifications within the spirit and scope of the present technology. Numerous characteristics and advantages have been set forth in the foregoing description, together with details of structure and function. The novel features are pointed out in the appended claims. The disclosure, however, is illustrative only and changes may be made in detail, especially in matters of shape, size, and arrangement of parts, within the principle of invention, to the full extent indicated by the broad general meaning of the terms in which the appended claims are expressed.

What is claimed is:

1. A board game comprising:

at least one pre-rolled flexible wave sheet having first and second surfaces, wherein when presented in a free state condition the sheet facilitates a slow curling, said first surface being the outside surface of the sheet and said second surface being the inside surface of the sheet;

at least one magnetic handle selectively brought against said first surface, said handle further comprising at least one first magnet disposed within said handle; and at least one magnetic figure holder, said at least one magnetic figure holder further comprising at least one second magnet disposed within said at least one magnetic figure holder, further comprising at least one action figure disposed on said at least one magnetic figure holder, wherein said magnetic figure holder is slidably disposed onto said second surface of said wave sheet and is magnetically coupled to said magnetic handle to create at least one game level of difficulty.

2. The game of claim 1, where the wave sheet is attached to at least one base holder that is further attached to a base.

3. The game of claim 1, where the wave sheet is attached to at least one base using adhesive tape.

4. The game of claim 1, wherein the game level of difficulty is created by the friction coefficient of said magnets against said wave sheet, the strength of the magnetic field of said magnets, the position of the center of gravity of said action figure relative to said wave sheet and at least one obstacle disposed on said wave sheet.

5. The game of claim 1, wherein the player will use said handle bar to make maneuvers on said wave sheet in order to avoid the magnetic field detachment of said magnetic figure holder.

6. The game of claim 1, wherein the containment of the angular roll-force of the wave sheet is accomplished by the use of at least one wave former and at least one wear-strip.

7. The game of claim 1, wherein said wave sheet is coated from materials selected from the group consisting of; organic and non organic waxes, UV curable epoxies, acrylic monomers, fluoropolymer composites (PTFE), prepolymers, halogenated compounds, polymer resins, petroleum polymers, and styrene polymers.

8. The game of claim 1, wherein said wave sheet is made from materials selected from the group consisting of polymers or plastics, sheet of heavy paper, card board stock, bent plexi-glass, cellulose materials, thin flexible metals, flexible gypsum cloth and heavy cloth.

9. The game of claim 1, where said wave sheet mimics a wave.

* * * * *